US010096245B2

(12) United States Patent
Mielenz

(10) Patent No.: US 10,096,245 B2
(45) Date of Patent: Oct. 9, 2018

(54) METHOD FOR SUPPLYING A SIGNAL FOR AT LEAST ONE VEHICLE

(71) Applicant: Robert Bosch GmbH, Stuttgart (DE)

(72) Inventor: Holger Mielenz, Ostfildern (DE)

(73) Assignee: ROBERT BOSCH GMBH, Stuttgart (DE)

( * ) Notice: Subject to any disclaimer, the term of this patent is extended or adjusted under 35 U.S.C. 154(b) by 0 days.

(21) Appl. No.: 15/816,696

(22) Filed: Nov. 17, 2017

(65) Prior Publication Data

US 2018/0144629 A1 May 24, 2018

(30) Foreign Application Priority Data

Nov. 24, 2016 (DE) ..... 10 2016 223 350

(51) Int. Cl.

| | |
|---|---|
| ***G08G 1/0967*** | (2006.01) |
| ***G08G 1/01*** | (2006.01) |
| ***G08G 1/07*** | (2006.01) |
| ***G08G 1/09*** | (2006.01) |
| ***G08G 1/0962*** | (2006.01) |
| ***G08G 1/08*** | (2006.01) |

(52) U.S. Cl.

CPC ..... *G08G 1/096791* (2013.01); *G08G 1/01* (2013.01); *G08G 1/0104* (2013.01); *G08G 1/0112* (2013.01); *G08G 1/0116* (2013.01); *G08G 1/0133* (2013.01); *G08G 1/0141* (2013.01); *G08G 1/0145* (2013.01); *G08G 1/07* (2013.01); *G08G 1/075* (2013.01); *G08G 1/08* (2013.01); *G08G 1/09* (2013.01); *G08G 1/0962* (2013.01); *G08G 1/0967* (2013.01); *G08G 1/09626* (2013.01); *G08G 1/09675* (2013.01); *G08G 1/096708* (2013.01); *G08G 1/096716* (2013.01); *G08G 1/096725* (2013.01); *G08G 1/096766* (2013.01)

(58) Field of Classification Search

CPC ..... G08G 1/01; G08G 1/0104; G08G 1/07; G08G 1/075; G08G 1/08; G08G 1/09; G08G 1/0962; G08G 1/0967; G08G 1/096708; G08G 1/096766; G08G 1/096791

See application file for complete search history.

(56) References Cited

U.S. PATENT DOCUMENTS

| | | | | |
|---|---|---|---|---|
| 5,182,555 A * | 1/1993 | Sumner | G08G 1/0104 | 340/905 |
| 6,223,125 B1 * | 4/2001 | Hall | G08G 1/164 | 701/117 |
| 6,587,778 B2 * | 7/2003 | Stallard | G08G 1/01 | 340/901 |
| 9,511,767 B1 * | 12/2016 | Okumura | G08G 1/0133 | |

* cited by examiner

*Primary Examiner* — Andrew W Bee

(74) *Attorney, Agent, or Firm* — Norton Rose Fulbright US LLP; Gerard Messina

(57) ABSTRACT

A method for supplying a signal for at least one vehicle that is located in front of an entry point into a traffic node, it is provided that the method includes a step of detecting a traffic density at an exit point of the traffic node, as well as a step of supplying a signal as a function of the traffic density at an exit point of the traffic node.

17 Claims, 3 Drawing Sheets

METHOD FOR SUPPLYING A SIGNAL FOR AT LEAST ONE VEHICLE

CROSS REFERENCE

The present application claims the benefit under 35 U.S.C. § 119 of German Patent Application No. DE 102016223350.5 filed on Nov. 24, 2016, which is expressly incorporated herein by reference in its entirety.

FIELD

The present invention relates to a method and to a device for supplying a signal for at least one vehicle.

BACKGROUND INFORMATION

Conventionally, events, e.g., on a traffic route that lies ahead and is used for an efficient navigation to an input destination, are made available to an operator of a vehicle, for instance by signals in driver-information systems. Signals that feature high dynamics, for example, and are able to warn of imminent dangers, e.g., tail ends of backed-up traffic or broken-down vehicles, are also made available.

SUMMARY

An example method according to the present invention and an example device according to the present invention for supplying a signal for at least one vehicle that is located in front of an entry point to a traffic node include the detection of a traffic density at the exit point of the traffic node and the supply of a signal as a function of the traffic density at the exit point of the traffic node.

The vehicle, as described here for the execution of the method according to the present invention, may be a driverless vehicle or also a vehicle under the control of a driver. A road vehicle is also possible, as are vehicles that are able to swim, dive or fly, as well as vehicles that encompass a plurality of these various types of vehicles. The vehicle, as described here for the method according to the present invention, may be a partially or a highly automated vehicle, for example.

In accordance with the present invention, the vehicle, which is located in front of an entry point to a traffic node, is advantageously able to be notified of the traffic density at the intended exit point of the traffic node even before entering the traffic node, the notification taking the form of a signal. This may turn out to be advantageous at times of high traffic density, for instance. Because of high traffic density, e.g., backed-up traffic, in the region of the intended exit point from the traffic circle, for example, the vehicle, which is coming from the entry point of the traffic node, is only able to enter the traffic node but not leave the traffic node at the intended exit point, for example. In an advantageous manner, the signal makes it possible to provide the traffic density in the area of the exit point of the traffic node before the vehicle enters the traffic node. Advantageous predictive driving of the vehicle in the area of the traffic node is therefore possible, in which the traffic density in the region of the intended exit point of the traffic node may already be taken into account in the operation of the vehicle before the vehicle enters the traffic node. The example method according to the present invention therefore allows for a predictive ascertainment of currently existing or imminent high traffic densities, e.g., stopped traffic or congestion, at exit points of traffic nodes. Thus, for example, it is also possible to notify the operator of the vehicle of the most optimal point in time for entering a traffic node. The signal may advantageously be used for driver-information systems or for systems for the partial automation or for the automation of vehicles in an effort to improve the throughput rate of vehicles at traffic nodes.

In addition, for example, situations in which there is an imminent chance of congestion at traffic nodes are also able to be predicted in an advantageous manner.

In one especially preferred specific embodiment, the vehicle enters the traffic node as a function of the signal, or the vehicle decelerates in a region of an entry point to the traffic node and/or comes to a standstill in the region of the entry point to the traffic node. This advantageously makes it possible to avoid situations in which the vehicle enters the traffic node but is unable to leave the traffic node at the desired exit point because of high traffic density at the intended exit point. For example, if the vehicle is unable to leave the traffic node via the intended exit point on account of an excessive traffic density, then the vehicle, as a result of the supplied signal, is able to be prevented from entering the traffic node in a predictive manner. Backed-up traffic or blockages at the traffic node that are caused by the vehicle and might impede other vehicles are therefore avoidable in an advantageous manner, and the throughput rate of vehicles at the traffic node is advantageously able to be improved. An improved throughput rate at a traffic node is advantageous inasmuch as it allows for a more efficient use of energy resources in the overall balance.

Data values that are representative of at least one trajectory of at least one further vehicle are advantageously called up from an external data source. The at least one trajectory of the further vehicle connects a further entry point of the further vehicle into the traffic node to a further exit point of the further vehicle from the traffic node, and the signal is detected as a function of the trajectory of the further vehicle. Cooperative driving is therefore able to be realized in an advantageous manner, in which, in a coordinated manner with one or more further vehicles at the same traffic node, the vehicle enters the traffic node and/or, for example, decelerates in the region of the entry point of the traffic node or comes to a standstill. For instance, the vehicle whose intended exit point is blocked on account of high traffic density may stop in the area of the entry point of the traffic node and, for example, even grant the right of way to the one further vehicle.

Because of the at least one further trajectory of the at least one further vehicle, it is also advantageously possible to ascertain the traffic density at the intended exit point of the vehicle from the traffic node. In systems that have a higher degree of automation, an existing or imminent high traffic density is therefore able to be detected, and the signal may be provided in such a way that the throughput rate of vehicles at the traffic node is advantageously improved.

Another advantage may be that a further traffic density at the further exit point from the traffic node of the further vehicle is detected and the signal is detected as a function of the further traffic density. In this way, the throughput rate of vehicles at traffic nodes is able to be further improved in an advantageous manner, for instance through a comparison of different traffic densities at different exit points of the traffic node.

In another especially advantageous method, the signal causes a further signal to be transmitted to the further vehicle. The further signal informs the further vehicle whether the vehicle is entering the traffic node or whether it decelerates and/or comes to a standstill in the region of the entry point to the traffic node. As a result, it is possible to communicate a driving intention of the vehicle to the further vehicle. In systems that feature a high degree of automation, the cooperative driving strategy thus allows for a satisfactory and advantageous mutual adaptation of different vehicles at the traffic node, which further improves the throughput rate of vehicles at the traffic nodes.

In a particularly advantageous manner, the vehicle is operated as a function of the provided signal, and a decision as to whether the vehicle will enter the traffic node is made on the basis of the provided signal.

In an also advantageous manner, the signal is made available in such a way that the signal is output to at least one operator of the vehicle, the output taking place optically and/or acoustically and/or haptically. In this way, for example, the signal may form the basis for a decision by the operator of the vehicle as to whether the vehicle should enter the traffic node or should decelerate and/or stop in the region of the entry point of the traffic node, in order to thereby allow an unimpeded or easier passage through the traffic node by other vehicles, for example.

In one advantageous exemplary embodiment, the traffic node is a traffic circle. A traffic circle is characterized by a right-of-way control that is dependent on the situation, which is why the usefulness of the method according to the present invention is particularly high when a traffic circle functions as the traffic node.

According to the present invention, a device is provided for supplying a signal for at least one vehicle. The device includes a traffic-density detection system, which is employed to acquire a traffic density at an exit point of a traffic node; it furthermore includes first arrangement by which a signal is made available as a function of the traffic density at the exit point from the traffic node.

The traffic-density detection system and/or the first arrangement is/are preferably designed to execute a method as described herein.

A computer program is advantageously designed to execute a method as described herein.

Advantageous further developments of the present invention are described herein.

BRIEF DESCRIPTION OF THE DRAWINGS

Exemplary embodiments of the present invention are illustrated in the figures and are described in greater detail below.

DETAILED DESCRIPTION OF EXAMPLE EMBODIMENTS

Figure 1:
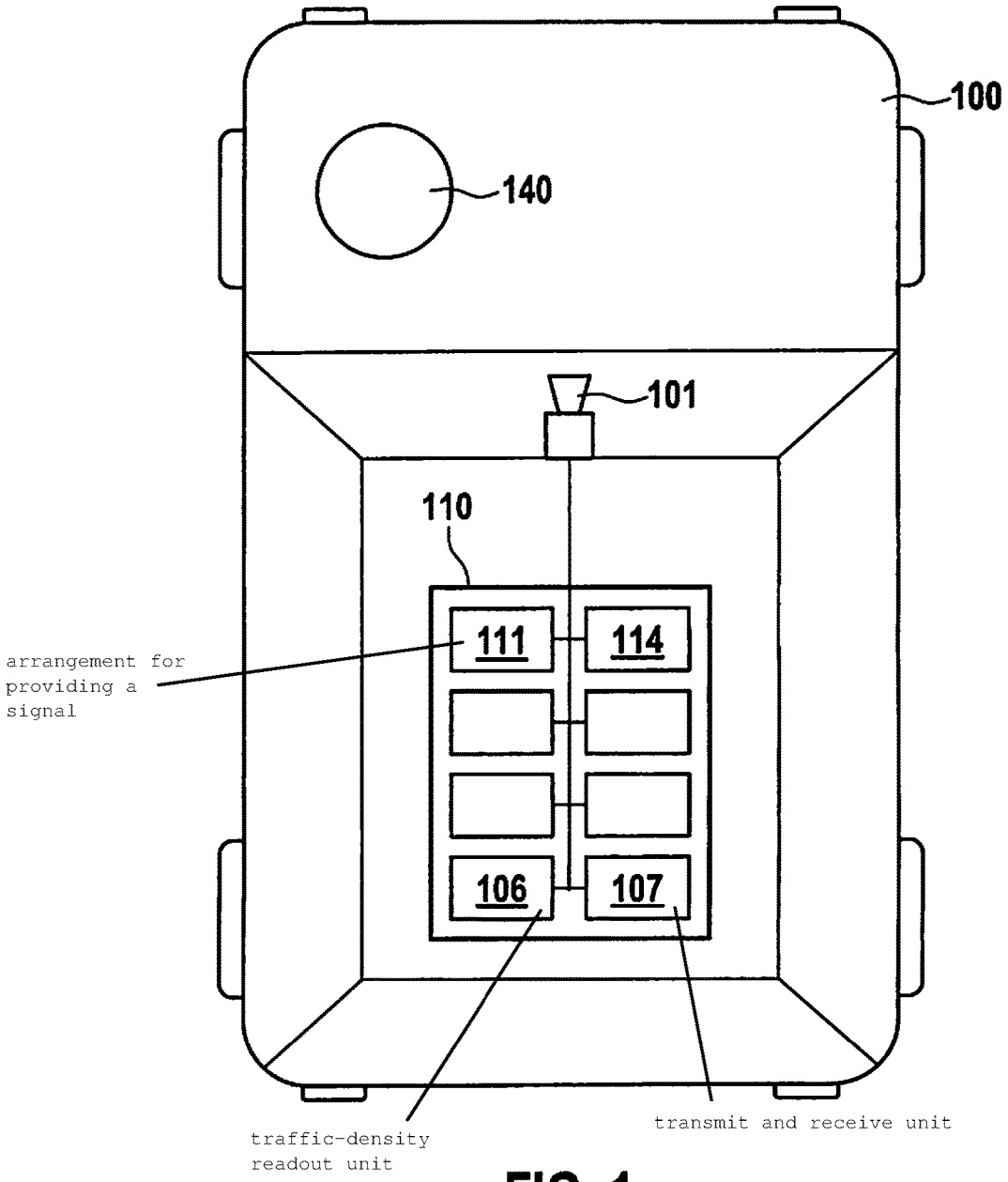
FIG. 1 shows, purely by way of example, a vehicle that includes the device according to the present invention, by which the method of the present invention for providing a signal for at least one vehicle is executed.

Purely by way of example, FIG. 1 shows a vehicle 100, which includes device 110 according to the present invention. Device 110 is used for executing the method according to the present invention for supplying a signal for at least one vehicle 100.

Figure 2:
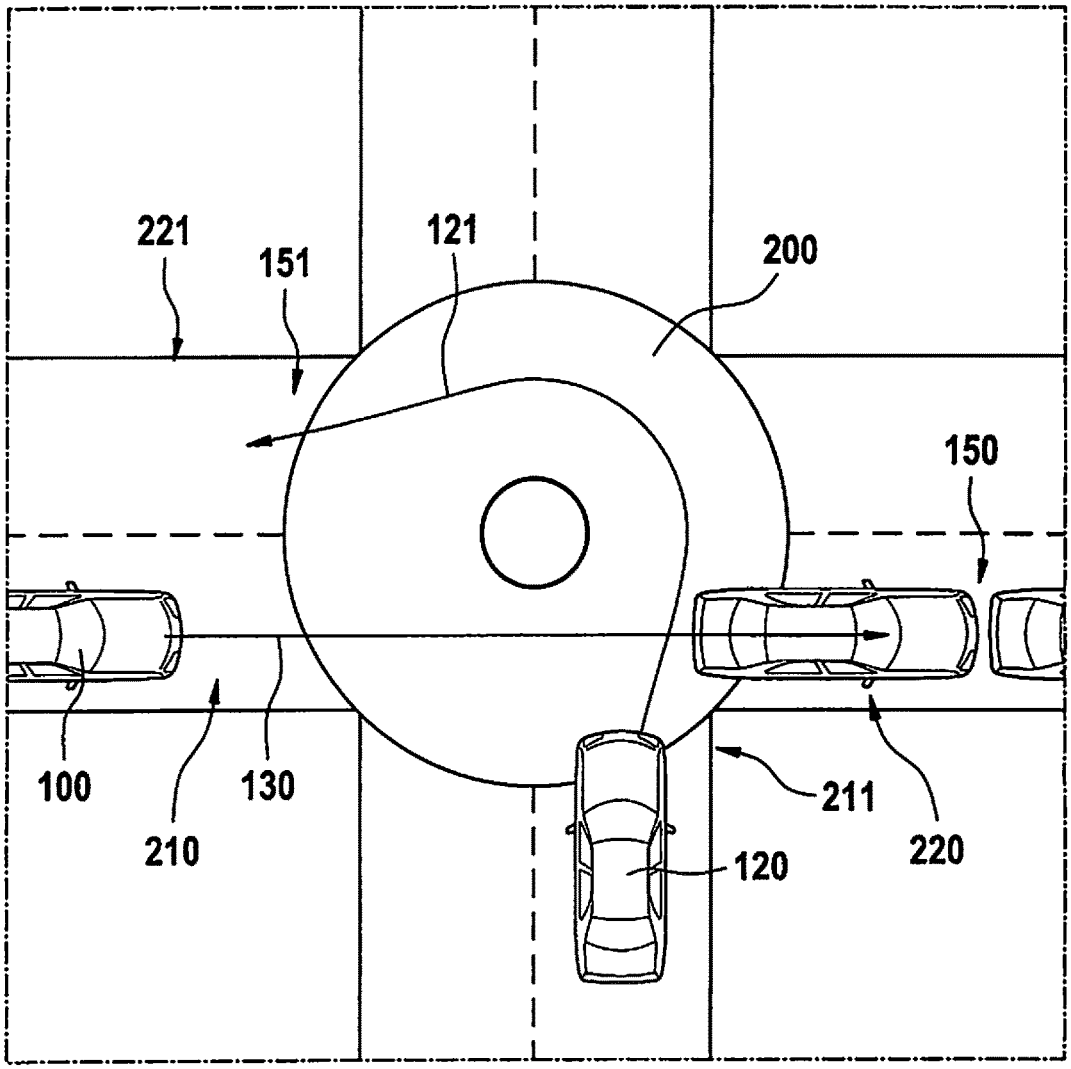
FIG. 2 shows an exemplary embodiment of the method according to the present invention for providing a signal for at least one vehicle.

Referring additionally to FIG. 2, in this particular exemplary embodiment, device 110 includes a traffic-density detection system 101. Traffic-density detection system 101 is employed to detect a traffic density 150 at an exit point 220 of a traffic node 200.

For example, traffic-density detection system 101 may also encompass a navigation system or also other systems which include a map that indicates street courses with traffic nodes 200 or also a dynamic traffic flow, for example. With the aid of the map, it is therefore possible to detect traffic densities 150, 151, traffic nodes 200, trajectories 121, 130 of vehicles 100, 120, or also entry points 210, 211 of individual vehicles 100, 120 and/or exit points 220, 221 of individual vehicles 100, 120 into or out of traffic nodes 200.

Another specific embodiment of traffic-density detection system 101 provides for a transmit and receive unit 107. In this way it is possible, additionally or independently of the already described specific embodiments, to call up, for example, traffic densities 150, 151 and/or trajectories 121, 130 of vehicles 100, 120 from an external data source. In the context of the present invention, an external data source refers to a data source that is external to vehicle 100, 120, i.e. one that is not installed in vehicle 100, 120. The map, for instance, may be expanded by missing trajectories 121, 130 and or traffic densities 150, 151. More specifically, in the present invention the further trajectories 151 and/or traffic densities 150, 151 and/or traffic nodes 200, and/or entry points 210, 211 and or exit points 220, 221, for example, are at least partially able to be called up from the external data source.

In addition, this type of traffic-density detection system 101 also may include a traffic-density readout unit 106, which is able to read out the traffic density from the map, for example.

Moreover, device 110 for operating the at least one vehicle 100 includes first arrangement 111, which provides a signal as a function of the traffic density at exit point 220 of traffic node 200.

In this exemplary embodiment, device 110 may additionally include second arrangement 112 by which vehicle 100 is operated as a function of the supplied signal, a decision as to whether vehicle 100 will enter traffic node 200 then being made on the basis of the supplied signal. Second arrangement 112 is designed to carry out any possible operation of vehicle 100 as a function of the supplied signal. This includes both an operation under safety-relevant aspects and an operation under locomotion-relevant aspects.

FIG. 2 shows an exemplary embodiment of the method for supplying a signal for at least one vehicle 100 according to the present invention. A traffic node 200 is illustrated in FIG. 2. In this particular exemplary embodiment, traffic node 200 is a traffic circle. However, a traffic node 200 may also be an intersection or a junction where one or more side roads merge into a main traffic artery, for example. It may involve traffic nodes 200 featuring situation-dependent right-of-way rules or also traffic nodes 200 with right-of-way rules that are not situation-dependent or that are only partially situation-dependent, i.e. intersections with traffic lights.

As illustrated in FIG. 2, in this exemplary embodiment vehicle 100 is located in front of an entry point 210 into a traffic node 200. A trajectory 130 of vehicle 100 through traffic node 200 is illustrated by an arrow in FIG. 2. Trajectory 130 of vehicle 100 thus connects entry point 210 of vehicle 100 into traffic node 200 to exit point 220 of vehicle 100 from traffic node 200.

In the context of the present invention, entry point 210, 211 or exit point 220, 221 are areas of roads that adjoin a traffic node 200. Whether an entry point 210, 211 or an exit point 220, 221 is involved has to be examined relative to respective vehicle 110, 120. Viewed in the direction of travel of vehicle 100, 120 along trajectory 121, 130, vehicle 100, 120 enters traffic node 200 by way of entry point 210, 211 of vehicle 100, 120 and then exits from traffic node 200 again by way of exit point 220, 211.

In this exemplary embodiment, traffic density 150 is detected at exit point 220 of traffic node 200. The detection of traffic density 150 at exit point 220 of traffic node 200 may also be carried out in a predictive manner, for example.

A signal is supplied as a function of traffic density 150 at exit point 220 of vehicle 100 from traffic node 200. For example, the signal may indicate whether vehicle 100 would be able to pass directly through traffic node 200. The signal may indicate whether traffic density 150 at exit point 220 of traffic node 200 exceeds a threshold value according to predefined criteria, for instance. As a result, the signal may indicate whether traffic density 150 at exit point 220 of traffic node 200 is too high to allow vehicle 100 to exit from traffic node 200 through exit point 220 of vehicle 100. In this particular exemplary embodiment, vehicle 100 enters traffic node 200 as a function of the signal or it decelerates in an area of entry point 210 of traffic node 200 and/or comes to a standstill there. The decision as to whether or not vehicle 100 will enter traffic node 200 may depend on the threshold value, for example.

For instance, additional vehicles 120 are able to be included in the present method, such as in the car-to-car communication as in this exemplary embodiment. For example, in this particular exemplary embodiment, data values that are representative of a trajectory 121 of further vehicle 120 are called up from an external data source, for instance. Trajectory 121 of further vehicle 120 connects another entry point 211 of further vehicle 120 into traffic node 200 with a further exit point 221 of further vehicle 120 from traffic node 200. In this exemplary embodiment, the signal is also generated as a function of trajectory 121 of further vehicle 120. Traffic density 150 at exit point 220 is detected as a function of the at least one further trajectory 121 in this exemplary embodiment.

In addition to traffic density 150, an additional traffic density 151 at a further exit point 221 of further vehicle 120 from traffic node 200 is detected in this exemplary embodiment, and the signal is acquired as a function of further traffic density 151.

In the exemplary embodiment shown in FIG. 2, another signal is transmitted to further vehicle 120 as a result of the signal. This further signal informs further vehicle 120 whether vehicle 100 enters traffic node 200 or decelerates in the region of entry point 210 of traffic node 200 and/or comes to a standstill.

In this exemplary embodiment, vehicle 100 is operated as a function of the supplied signal. The supplied signal is used as the basis of a decision as to whether vehicle 100 will enter traffic node 200.

In this exemplary embodiment, the signal is supplied in such a way that the signal is output to at least one operator 140 of vehicle 100. The output of the signal may occur optically and/or acoustically and/or haptically.

In addition, values of environmental data, for example, may be taken into account in the present method. These values are able to be determined from an environment of vehicle 100 and/or from an environment of further vehicle 120, e.g., traffic signs, traffic lights, stop lines or other markings that form the basis of right-of-way rules and cause vehicles 100, 120 to stop and/or decelerate.

Figure 3:
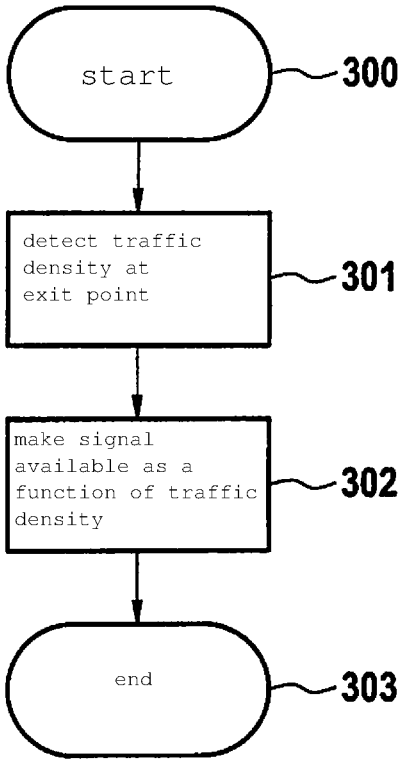
FIG. 3 shows an exemplary flow diagram of the method according to the present invention for supplying a signal for at least one vehicle.

FIG. 3 shows an exemplary flow diagram of the method for providing a signal for at least one vehicle according to the present invention.

The method begins in step 300.

In step 301, a traffic density at an exit point 220 of a traffic node 200 is detected.

In step 302, a signal is made available as a function of the traffic density at exit point 220 of traffic node 200.

The present method ends in step 303.

Still further exemplary embodiments and mixed forms of the illustrated exemplary embodiments are of course possible as well.

What is claimed is:

1. A method for supplying a signal for at least one vehicle that is located in front of an entry point into a traffic node, the method comprising:

detecting a traffic density at an exit point of the traffic node; and supplying a signal as a function of the traffic density at the exit point of the traffic node;

wherein data values that are representative of at least one trajectory of at least one further vehicle are called up from an external data source, the at least one trajectory of the further vehicle connecting a further entry point of the further vehicle into the traffic node to a further exit point of the further vehicle from the traffic node, and the signal being generated as a function of the trajectory of the further vehicle.

2. The method as recited in claim 1, wherein the vehicle at least one of:

(i) enters the traffic node as a function of the signal, (ii) decelerates in an area of an entry point into the traffic node, and (iii) comes to a standstill in the area of the entry point of the traffic node.

3. The method as recited in claim 1, wherein the traffic density at the exit point is detected as a function of the at least one trajectory of the at least one further vehicle.

4. The method as recited in claim 1 wherein a further traffic density at the further exit point from the traffic node of the further vehicle is detected and the signal is detected as a function of the further traffic density.

5. The method as recited in claim 1, wherein, due to the signal, a further signal is transmitted to the further vehicle, which informs the further vehicle whether the vehicle at least one of: (i) enters the traffic node, (ii) decelerates in an area of the entry point of the traffic node, or (iii) comes to a standstill in the area of the entry point of the traffic node.

6. The method as recited in claim 1, wherein the vehicle is operated as a function of the supplied signal, and a decision as to whether the vehicle enters the traffic node is made on the basis of the supplied signal.

7. The method as recited in claim 1, wherein the supply of the signal takes place in such a way that the signal is output to at least one operator of the vehicle, the output taking place in at least one of: (i) an optical manner, (ii) an acoustic manner, and (iii) a haptic manner.

8. The method as recited in claim 1, wherein the traffic node is a traffic circle.

9. A device for supplying a signal for at least one vehicle, comprising:

a traffic-density detection system to detect a traffic density at an exit point of a traffic node; and a first arrangement by which a signal is supplied as a function of the traffic density at the exit point of the traffic node;

wherein data values that are representative of at least one trajectory of at least one further vehicle are called up from an external data source, the at least one trajectory of the further vehicle connecting a further entry point of the further vehicle into the traffic node to a further exit point of the further vehicle from the traffic node, and the signal being generated as a function of the trajectory of the further vehicle.

10. A non-transitory computer-readable storage medium on which is stored a computer program, which is executable by a processor, comprising:

a program code arrangement having program code for supplying a signal for at least one vehicle that is located in front of an entry point into a traffic node, by performing the following:

detecting a traffic density at an exit point of the traffic node; and supplying a signal as a function of the traffic density at the exit point of the traffic node;

wherein data values that are representative of at least one trajectory of at least one further vehicle are called up from an external data source, the at least one trajectory of the further vehicle connecting a further entry point of the further vehicle into the traffic node to a further exit point of the further vehicle from the traffic node, and the signal being generated as a function of the trajectory of the further vehicle.

11. The non-transitory computer-readable storage medium as recited in claim 10, wherein the vehicle at least one of: (i) enters the traffic node as a function of the signal, (ii) decelerates in an area of an entry point into the traffic node, and (iii) comes to a standstill in the area of the entry point of the traffic node.

12. The non-transitory computer-readable storage medium as recited in claim 10, wherein the traffic density at the exit point is detected as a function of the at least one trajectory of the at least one further vehicle.

13. The non-transitory computer-readable storage medium as recited in claim 10, wherein a further traffic density at the further exit point from the traffic node of the further vehicle is detected and the signal is detected as a function of the further traffic density.

14. The non-transitory computer-readable storage medium as recited in claim 10, wherein, due to the signal, a further signal is transmitted to the further vehicle, which informs the further vehicle whether the vehicle at least one of: (i) enters the traffic node, (ii) decelerates in an area of the entry point of the traffic node, or (iii) comes to a standstill in the area of the entry point of the traffic node.

15. The non-transitory computer-readable storage medium as recited in claim 10, wherein the vehicle is operated as a function of the supplied signal, and a decision as to whether the vehicle enters the traffic node is made on the basis of the supplied signal.

16. The non-transitory computer-readable storage medium as recited in claim 10, wherein the supply of the signal takes place in such a way that the signal is output to at least one operator of the vehicle, the output taking place in at least one of: (i) an optical manner, (ii) an acoustic manner, and (iii) a haptic manner.

17. The non-transitory computer-readable storage medium as recited in claim 10, wherein the traffic node is a traffic circle.

* * * * *